United States Patent [19]

Weisenburger

[11] Patent Number: 4,589,715

[45] Date of Patent: May 20, 1986

[54] ELECTRICAL CONNECTOR KIT

[75] Inventor: Lawrence P. Weisenburger, Kernersville, N.C.

[73] Assignee: AMP Incorporated, Harrisburg, Pa.

[21] Appl. No.: 689,496

[22] Filed: Jan. 7, 1985

Related U.S. Application Data

[63] Continuation of Ser. No. 501,598, Jun. 6, 1983, abandoned.

[51] Int. Cl.[4] ..... H01R 9/09

[52] U.S. Cl. ..... 339/17 F; 339/18 R; 339/97 P; 339/122 R; 339/155 R

[58] Field of Search ..... 339/17 F, 17 M, 176 M, 339/176 MF, 18 R, 18 C, 18 P, 31 R, 31 M, 32 R, 32 M, 155 R, 122 R, 122 F, 123, 154 A, 155 R, 156 R, 97 R, 97 P

[56] References Cited

U.S. PATENT DOCUMENTS

| | | | |
|---|---|---|---|
| 2,613,287 | 10/1952 | Geiger | 339/18 C |
| 3,193,789 | 7/1965 | Brown | 339/18 R |
| 3,212,048 | 10/1965 | Rosenberg et al. | 339/18 R |
| 3,356,786 | 12/1967 | Helms | 339/18 C |
| 3,364,300 | 1/1968 | Bradham, III | 339/18 C |
| 3,701,964 | 10/1972 | Cronin | 339/18 C |
| 4,286,835 | 9/1981 | Adams | 339/122 R |
| 4,313,646 | 2/1982 | Millhimes et al. | 339/156 R |
| 4,463,998 | 8/1984 | Reavis et al. | 339/40 |
| 4,470,656 | 9/1984 | Moser et al. . | |

*Primary Examiner*—John McQuade

*Attorney, Agent, or Firm*—Robert W. Pitts

[57] ABSTRACT

A kit for making a connector permitting alternative interconnections between individual conductors of two parallel, planar arrays of conductors includes an insulating body with means to locate contact parts on opposite faces for alignment with chosen conductor to provide the alternative interconnections. The contacts are of three basic types comprising respectively a conductor engaging portion integrally joined to either a bus portion, a bus gripping portion or another conductor engaging portion. The locating means includes recesses on opposite faces communicating by contact receiving sockets extending between the faces and bus receiving channels extending between recesses on the same face.

18 Claims, 15 Drawing Figures

Fig. 4A
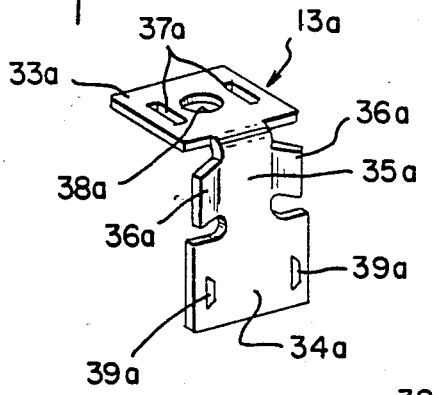
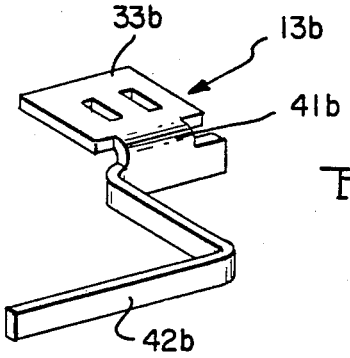
Fig. 4B
Fig. 4C
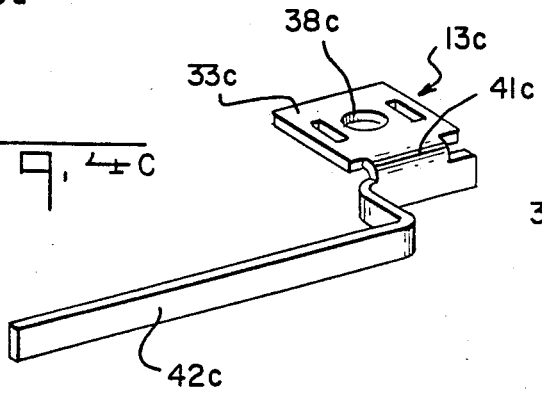
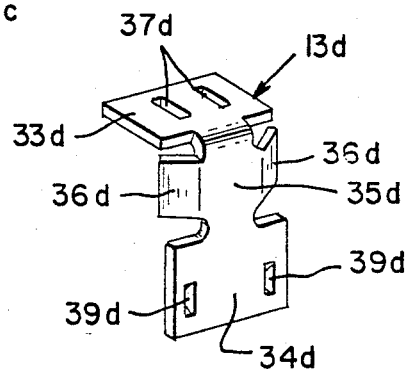
Fig. 4D
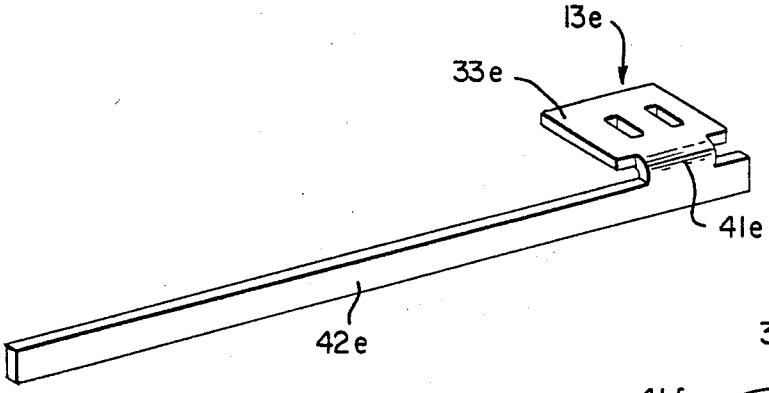
Fig. 4E
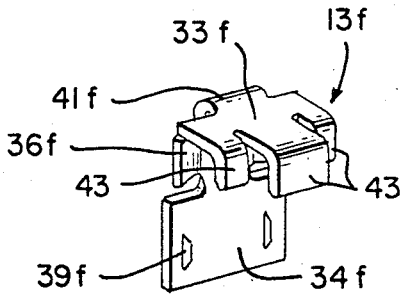
Fig. 4F

ELECTRICAL CONNECTOR KIT

This application is a continuation of application Ser. No. 501,598, filed June 6, 1983, now abandoned.

The invention relates to a connector for connecting individual conductors of a first planar array of conductors to preselected alternative individual conductors of a second, parallel, planar array, at least some of the individual conductors of the second array being laterally spaced from individual conductors of the first array. In particular, the invention relates to a kit for making such connector.

As a result of the increasing demand for complex electrical wiring, there is frequently a requirement to interconnect individual conductors of planar arrays of conductors, for example, of two flat cables, which conductors are in parallel planes but displaced laterally from each other. In the interests of minimizing inventories and capital expenditure, it is also desirable to avoid a requirement for a different connector for each different combination of interconnections. At the same time, the connector should desirably be designed to facilitate fabrication by mass production techniques and relatively simple to assemble and use in the field, minimizing applied costs. in addition, the connector should be of relatively small size consistent with a requirement for compact and unobtrusive equipment, particularly in undercarpet cable applications where a low profile is important.

According to the invention, there is provided a kit for making a connector for connecting individual conductors of a first planar array of conductors to preselected alternative individual conductors of a second, parallel, planar array, at least some of the individual conductors of the second array being lateraly spaced from individual conductors of the first array, the kit comprising a plate-like insulating body formed with contact locating means to locate a plurality of first and second contact parts respectively on first and second opposite faces of the body for alignment with respective conductors of the first and second array, predetermined of the contact locating means including through-sockets extending between the faces, first and second contact parts for location in respective locating means, the first and second contact parts for location by the predetermined locating means being integrally joined together by body portions receivable in the through-sockets, bus-receiving channels extending laterally across the body between locating means for the second contact parts and the predetermined locating means, a bus portion adapted for location in preselected alternative channels electrically to connect preselected second contact parts with laterally-spaced first contact parts associated with the through-sockets whereby on interposing the connector erected from the kit between the first and second array of conductors preselected individual conductors of the second array can be connected to laterally-spaced conductors of the first array.

Thus, a single kit is suitable for establishing alternative interconnections.

The connector may constitute an adaptor for use for example, with a connector of the kind disclosed in U.S. Pat. No. 4,463,998, filed on Mar. 4, 1982, the disclosure of which is incorporated herein by reference in which conductor engaging contact elements are located on a cable engaging face of an insulating housing body at the same pitch as the conductors of a flat cable so that clamping the face against the cable effects connection between the aligned contact elements and the cable conductors. In use, the adaptor is inserted between the cable engaging face and the cable with the first and second contact parts aligned with the contact elements and cable conductors, respectively and one or more bus portions locaed in preselected channels to interconnect individual connecting elements of the flat cable connector with chosen conductors of the cable.

The contact elements of the flat cable connector comprise tabs having surfaces formed with outstanding knife edges adapted to penetrate conductor insulation of the cable and establish electrical connection with the core. The first contact parts may be tabs with recesses complimentary to the knife edges and the second contact parts may comprise tabs having insulation penetrating knife edges.

In a convenient more specific form, a contact part is integrally formed with means to grip a bus, which means is integrally joined to the contact part by a body portion receivable in a through socket with the bus gripping portion in a bus-receiving channel on one face and the contact part on the opposite face.

This facilitates the provision of a compact and stable structure that can readily be assembled in various combinations.

The kit may be designed particularly to enable the contact elements of a connector constructed for a single phase wiring array to be connected to preselected, alternative conductors of a three phase wiring array. In such case, there are three laterally spaced first and second aligned contact part locating means each including common through-sockets and two further second contact part locating means respectively laterally spaced to opposite sides of the second contact part locating means, the further second contact part locating means including through-sockets common to locating means for bus gripping portions on the first face, the bus-receiving channels respectively extending between the bus gripping portion locating means and distal and adjacent first contact part locating means, third bus receiving channels also extending between a bus gripping portion locating means and the central first contact part locating means.

In the interests of simplicity of structure and body strength, the third-channel includes a portion common with an adjacent channel.

Desirably, a first contact part is integrally formed with a bus strip of sufficient length to provide the precursor of any of the busportions, and the bus-gripping portion includes a tab formed to extend transversely of the body portion and provided at a free end with spaced bus gripping fingers returned for receipt in the bus-receiving channel.

Excess lengths of the bus portions may quickly be removed in the field and the bus portion bent to the desired configuration. Each contact part and the bus gripping parts may be stamped and formed from blanks identical in size minimizing capital equipment costs, the small structural differences readily being made by substituting alternative die inserts.

An example of a kit according to the invention will now be described with reference to the accompanying drawings in which.

Figure 3A:
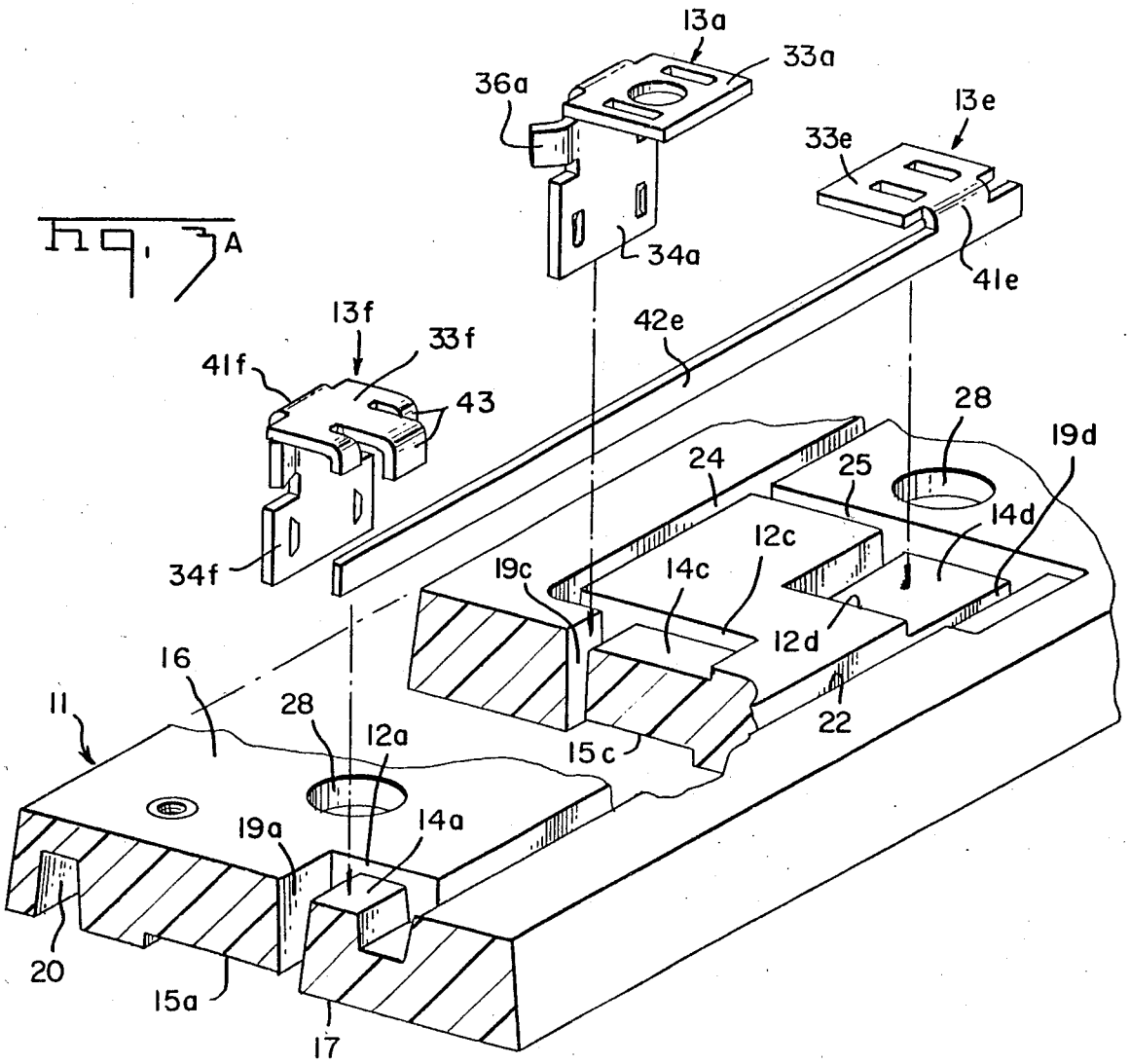
Figure 1:
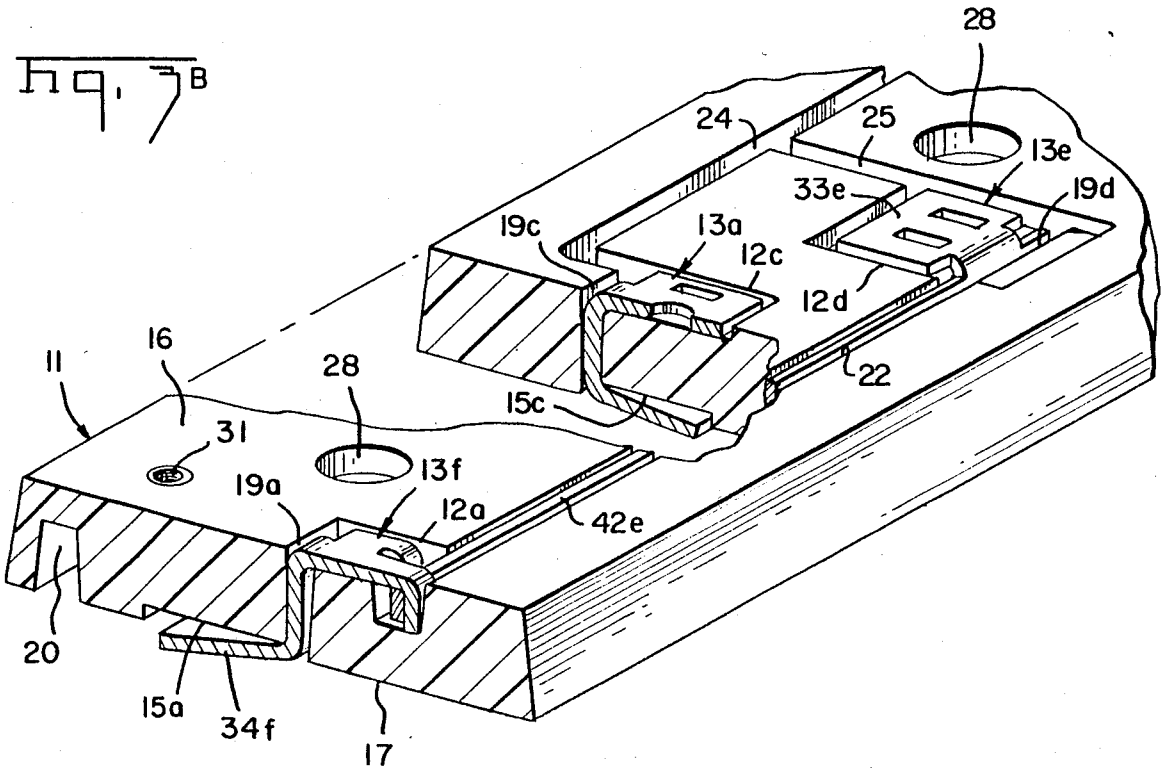

FIG. 3A and B are perspective views of the connector body partly in cross-section before and after assembly with contacts;

FIGS. 4A–F are perspective views of the individual contacts; and,

FIGS. 5A–E are perspective views of alternative connector and contact combinations to provide alternative interconnections between conductors located for single and three-phase suppliers.

The kit comprises a plate-like insulating body 11 formed with laterally spaced contact locating means 12*a–e* and a series of contacts 13*a–f* (FIG. 4A–F) partly formed for assembly with the body by location in preselected of the locating means.

The body 11 is moulded in one piece of suitable plastics material and the contact locating means 12*a–e* comprise first and second pairs of recesses 14*a–e* and 15*a–e*, respectively, on first and second opposite faces 16 and 17 of the body, respectively, the recesses of respective pairs intercommunicating by through sockets 19*a–e*, respectively extending between the faces. The three central recesses 14*b, c* and *d* on the first face and each of the recesses 15*a–e* on the second face have flat base walls for reception of contact parts, but the two outer recesses 14*a* and *e* communicate at ends remote from the through sockets with bus-receiving channels 22 and 24 which extend laterally across the first face and communicate with contact receiving recesses 14*d* and 14*c*, respectively. A third bus-receiving channel 25 extends between recess 14*d* and the approximate mid-point of channel 24. Locating posts 26*a* and *b* upstand from diagonally opposite corners of the second face 17 and a series of sockets 28 for the receipt of self-tapping clamping screws 29 (FIG. 1) extend in symmetrically spaced relation across the centre line of the body. Locating sockets 30 are formed in the first, upper face 16 adjacent opposite edges of the body on respective opposite sides of the centre line. Two further sockets 31 for the receipt of clamping screws 32 extend through the body on oppposite sides of the centre line. Cavities 20, 20' are formed adjacent opposite edges of the body in the interests of economy of material.

As shown more particularly in FIGS. 4A–F, the kit includes six different stamped and formed contacts 13*a–f*. The contact 13*a* comprises first and second tabs 33*a* and 34*a* joined by a neck 35*a* from respective opposite sides of which extend locating flanges 36*a*. The tabs 33*a* and 34*a* each constitute conductor engaging contact parts, a pair of locating recesses 37*a* being stamped in tab 33*a* on each side of a screw receiving aperture 38*a*. Insulating penetrating teeth 39*a* are pushed out of the tab 34*a*. For the convenience of the user to facilitate assembly with the body, the tab 33*a* may be bent to extend transversely of the neck 35*a* and tab 34*a* and the flange 36*a* bent out of the plane of the neck as shown.

The contact 13*a* is assembled with the body 11 by insertion from the first face of the body, second tab 34*a* leading into the central through-socket 19*c* so that the first tab 33*a* is received in a recess 14*c* on the first face of the body and the neck is received as an interference in the through socket. The second tab 34*a* is then bent to extend transversely of the neck under the first tab so that its inherent resiliency causes it to remain spaced from the body defining a small obtuse angle with the neck as shown in FIG. 3B. Subsequent engagement with a cable will enable sufficient resilient flexure of the tab towards the body with the teeth 39*a* remaining proud of the surface 17 to provide a permanent connection to the cable conductor.

The contact 13*d* shown in FIG. 4D is closely similar to the contact 13*a* except that the aperture 38*a* is omitted, locating recesses 37*d* are more closely spaced and the flanges 36*d* are bent to extend under the tab 33*d*. Assembly of contact 13*d* is similar to that of contact 13*a* except that tab 34*d* is bent to extend away from the tab 33*d*. Contact 13*d* is intended for location by either contact locating means 12*b* or 12*d* and contacts 13*b, c* and *e* are generally similar having tabs 33*b, c* and *e* constituting conductor engaging contact parts joined by short necks 41*b, c* and *e* to bus bars 42*b, c* and *e*. To facilitate assembly by the users, the bus bars are bent, as necessary, to enable receipt in channels 25 and 24, 24 or 22 corresponding to location of the contacts by locating means 12*d* (FIG. 5C), 12*c* (FIG. 5D & E) or 22 (FIG. 5B & E). It is envisaged that only contacts with straight busses need be supplied, the busses being cut to length and severed in the field.

As shown in FIGS. 4F, 3A and 3B, tab 33F is bent to extend transversely of neck 41*f* and bifurcated at a free end to form bus gripping spring fingers 43 returned towards the tab 34*f*. As shown in FIGS. 3A and B, assembly of the contact with the base and a bus bar is by receipt of the contact in locating means 12*a* (or 12*e*), tab 34 leading with bus 22 preloaded in channel 22 so that the fingers grip the bus between them. The tab 34*f* is then bent towards the base to the position shown in FIG. 3B.

Figure 1:
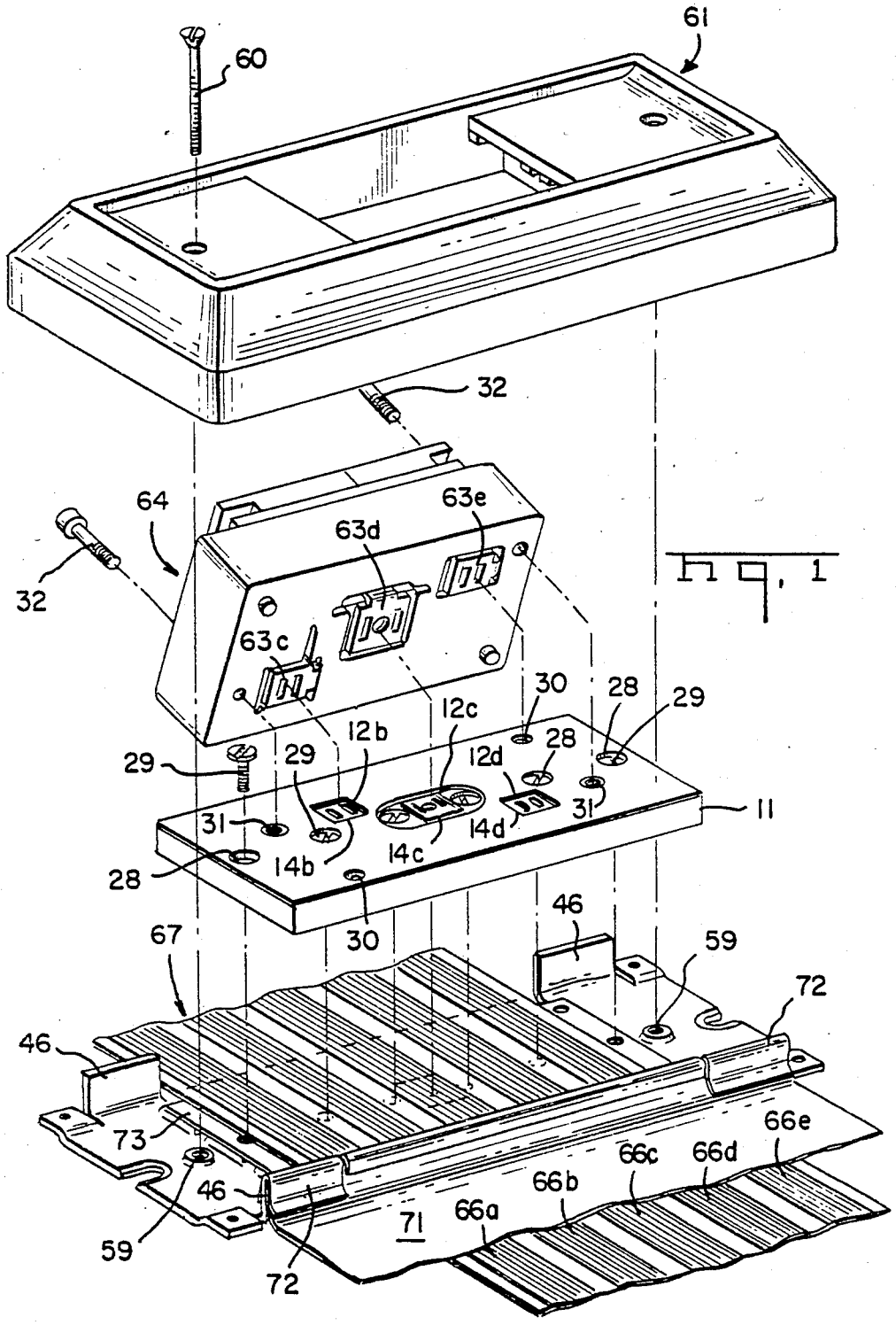
FIG. 1 is an exploded perspective view of a flat cable connector assembly incorporating a connector adaptor erected from the kit.
Figure 2:
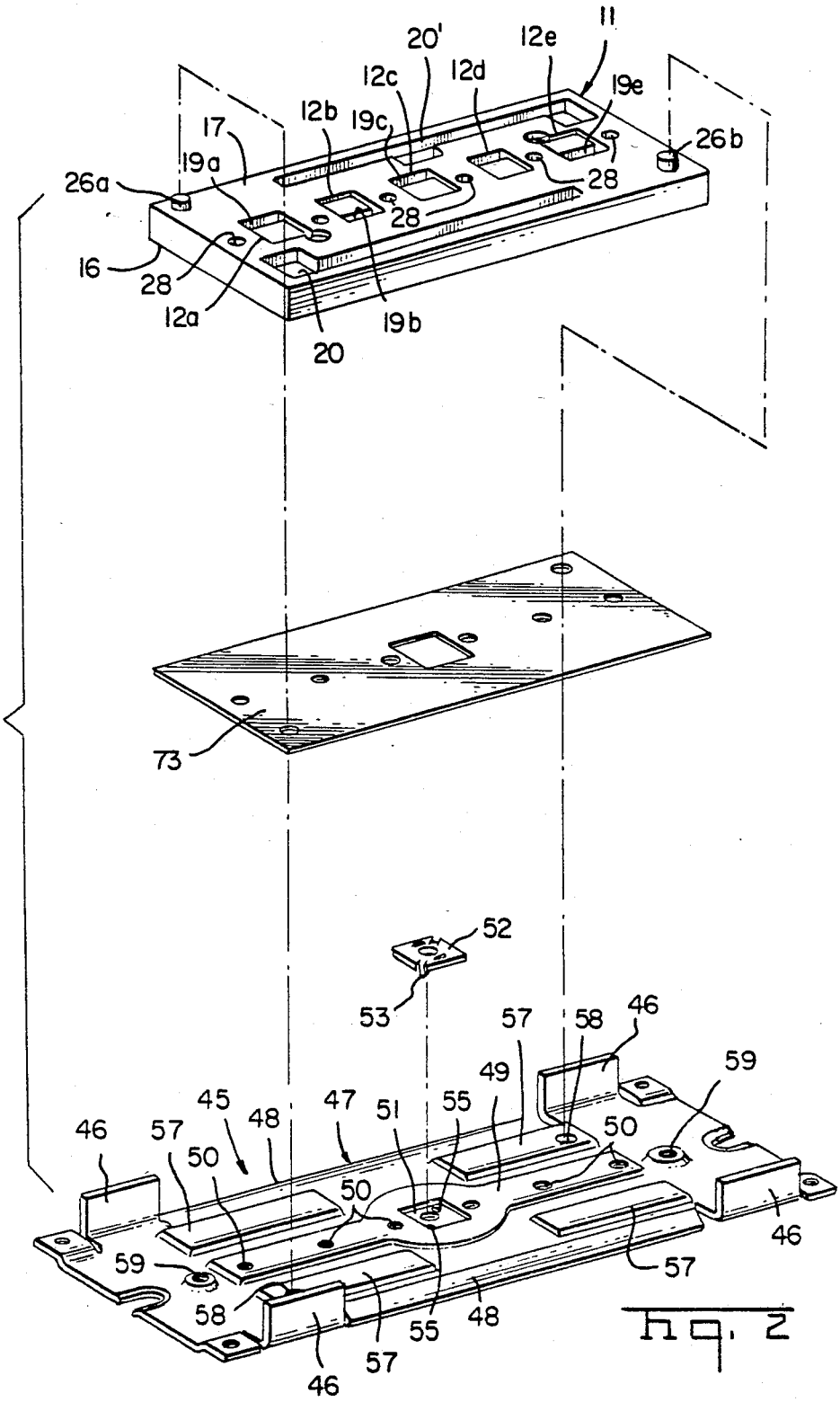
FIG. 2 is an exploded perspective showing in particular, the adaptor body and base plate.

As shown particularly in FIGS. 1 and 2, a stamped and formed base plate 45, particularly adapted for use with the connector adaptor includes flanges 46 bent up from opposite sides to define a central cable receiving portion 47 having downturned entry and exit surface 48 for the cable 67. A raised land 49 is pushed out along a centre line in alignment with the connecting parts and formed with clamping screw receiving apertures 50. A recessed portion 51 is formed in the centre land for receipt of a grounding contact 52 having locating tangs 53 struck from diametrically opposite corners for receipt in apertures 55 in the recess. Four further raised lands 57 are pushed out at symmetrical locations on the cable receiving portion, two of which are provided with apertures 58 for clamping screws. Two further apertures 59 are formed between the flanges 46 for the receipt of clamping screws 60 for a cover 61 (FIG. 1).

As stated above, the adaptor kit is designed to enable various combinations of connection between cable engaging contacts 63*c, d, e* of a known single phase duplex outlet 64 connector described in U.S. Pat. No. 4,463,998, and the individual conductors 66*a–e* of a triple phase flat cable 67. The conductors 66*a–e* correspond respectively to the secondary, neutral ground, primary and tertiary lines. When the three phase supply is not connected to the cable, the conductor 66*e* may be used as an alternative ground.

To assemble the cable with the base plate, an upper metal shield 71 of the cable is turned back and secured by U-form clips 72 (only one shown) to the flanges 46 so that an exposed insulated cable portion extends across the cable receiving portion of the base plate. The connector adaptor assembled with a chosen combination of contacts is covered with fish paper and clamped against the cable which overlies a layer of fish paper 73 by screws 29 so that the contacts establish connection to the individual conductors as required. The duplex outlet 64 is then clamped by screws 32 against the body so that conductors 63*c, d* and *e* engage tabs of contacts 12*b, c* and *d*. The cover is then clamped to the base plate by screws 60.

The combinations of interconnections that can be obtained using the kit are illustrated in FIGS. 5*a–e*.

Figure 5A:
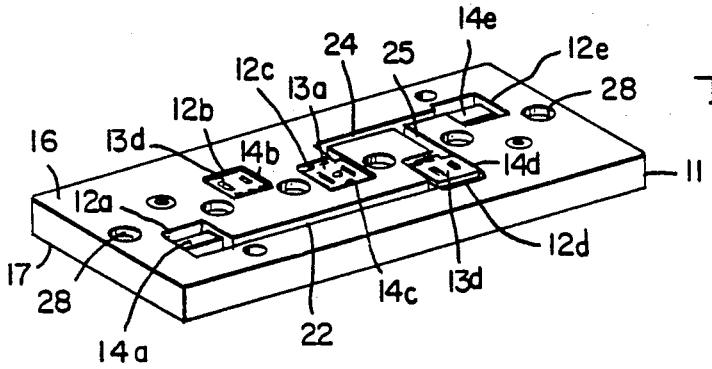
Figure 5B:
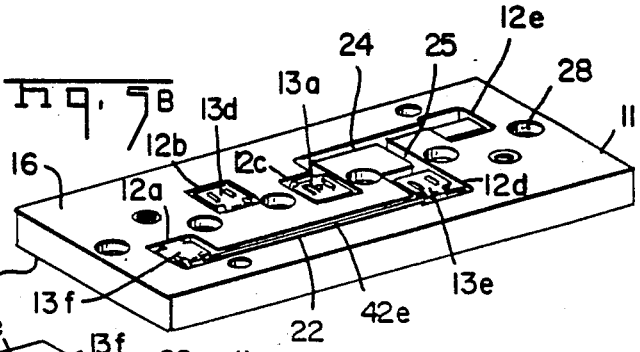

In FIG. 5A, a standard ground primary phase connection is obtained by using contacts 13*d* in locating means 12B and 12D and contacts 13A in 12C.

In FIG. 5B, a standard ground secondary phase connection is obtained by the use of contacts 13*a* in 12*c* as above, contacts 13*d* in 12*b*, spring contact 13*f* in 12*a* and contact 13*e* in 12*d*.

Figure 5C:
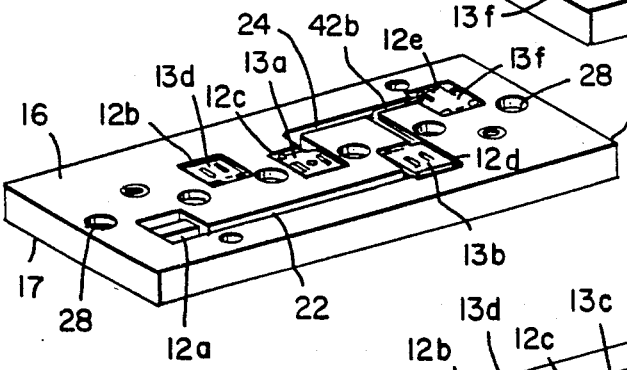

In FIG. 5C, a standard ground tertiary connection is obtained by locating contacts 13*a* and 13*d* as above, spring contact 13*f* in 12*e* and bus contact 13*b* in 12*d*.

Figure 5D:
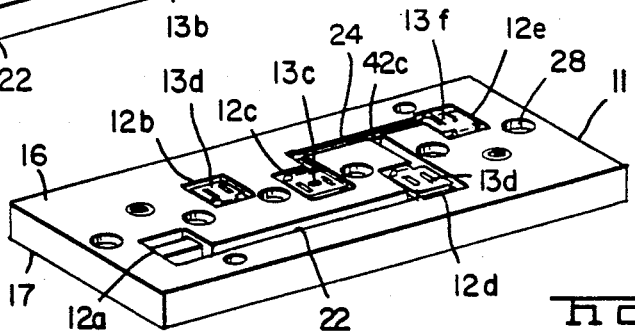

In FIG. 5D, an isolated ground primary phase connection is obtained by locating contacts 13*d* in 12*b* and 12*d*. bus contact 13*c* in 12*c*, and spring contact 13*f* in 12*e*.

Figure 5E:
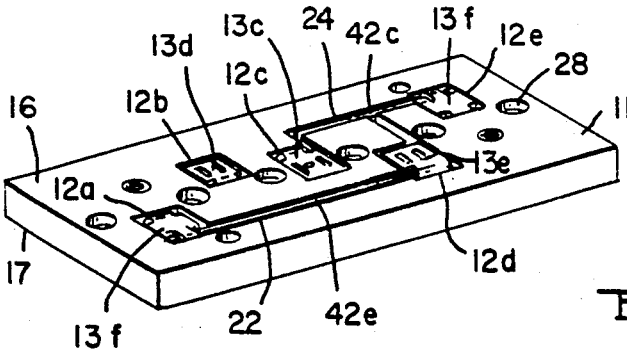

In FIG. 5E, an isolated ground secondary phase connection is obtained by locating contact 13*d* in 12*b*, respective bus contacts 13*c* and *e* in 12*c* and *d* spring contacts 13*f* in 12*a* and 12*e*.

The isolated ground requirement is necessary to prevent a surge (spike) possibility when the usual ground is connected to other equipment and is particularly sought in data applications.

It should be noted that in some other applications, only three different contacts may be required to obtain all of the above combinations of interconnection, namely contacts 13*b, d* and *e*, the apertures 38*a, c* for grounding screws not being required. Each tab may be of the same size minimizing die alterations when a series of different contacts are to be stamped and enabling the same press to be used.

I claim:

1. An adapter kit for use in connecting individual conductors of an upper array of coplanar flat conductors, consisting of contact elements, in a separate connector, to preselected alternative individual conductors of a lower, parallel array of coplanar flat conductors, consisting of a flat cable having a plurality of side by side flat conductors surrounded by electrical insulation, at least some of the individual conductors of the lower array being laterally spaced from individual conductors of the first array, the kit comprising a plate-like insulating body formed with contact locating means for locating a predetermined plurality of separate upper and lower contact parts respectively on upper and lower opposite faces, for alignment of upper contact parts with respective conductors of the upper array and for alignment of lower contact parts with respective conductors of the lower array, the predetermined contact locating means including through-sockets extending between the faces, upper and lower contact parts located in respective locating means; upper and lower contact parts in mutual alignment only being joined together by body portions receivable in the through-sockets and extending therebetween, bus channels extending laterally across the body between locating means on one surface of the insulating body; bus portions adapted for location in preselected alternative channels electrically to connect corresponding laterally spaced upper and lower contact parts whereby on interposing the adapter kit between the upper and lower array of conductors, preselected alternative individual conductors of the lower array can be connected to laterally-spaced conductors of the upper array.

2. A kit according to claim 1 in which a contact part is integrally formed with means to grip a bus portion.

3. A kit according to claim 2 in which the bus gripping means is integrally joined to the contact part by a body portion receivable in a through socket with the bus gripping means in a bus-receiving channel on one face and the contact part on the opposite face.

4. A kit according to claim 3 in which the through-socket for receiving the body portion is laterally spaced from the contact locating means on the face across which the bus receiving channels extend.

5. A kit according to claim 4 in which there are three, laterally spaced centrally disposed, upper and lower contact part locating means each including common through-sockets and two further lower contact part locating means, respectively, laterally spaced to opposite sides of the three centrally-disposed lower contact part locating means, the further lower contact part locating means including through-sockets common to locating means for a bus gripping portion on the upper face, the bus receiving channels respectively extending between the bus gripping means locating means and a distal and adjacent upper contact part locating means, a third bus receiving channel also extending between a bus gripping portion locating means and the centermost upper contact part locating means.

6. A kit according to claim 5 in which the third channel includes a portion common with an adjacent channel.

7. A kit according to claim 1 in which an upper contact part is integrally formed with a bus strip of sufficient length to provide the precursor of any of the bus portions.

8. A kit according to claim 3 in which the bus gripping portion includes a tab formed to extend transversely of the body portion and provided at a free end with spaced bus gripping fingers returned for receipt in the bus-receiving channel.

9. An assembly for distribution of electrical power, comprising;

a flat cable having a plurality of flat conductors disposed side-by-side and surrounded by electrical insulation, the flat cable including sufficient electrical conductors for the transmission of power in a system including primary, ground, alternate ground and neutral conductors;

a connector having a plurality of contact elements, each having conductor engagable portions comprising means for penetrating flat cable insulation into a flat conductor therein, the number of contact elements being less than the number of flat conductors;

an adapter assembly disposed between the connector and the flat cable conductors and including three adapter contact elements, each having an upper contact part in engagement with a corresponding conductor engagable connector contact element and a lower contact part, the lower contact parts of the adapter contact elements being selectively laterally disposable and having a conductor engagable portion penetrating flat cable insulation into a corresponding flat conductor; and conductive portions in the adapter assembly, joining corresponding upper and lower contact parts to form alternative distribution systems.

10. The assembly of claim 9 wherein the connector comprises three connector contact elements for single phase lower power distribution.

11. The assembly of claim 10 wherein the flat conductors are equally spaced having a constant pitch.

12. The assembly of claim 11 wherein the three connector contact elements are spaced apart on the same pitch as the flat conductors.

13. The assembly of claim 9 wherein the connector has a single ground contact element joined to a ground flat conductor laterally spaced therefrom.

14. Apparatus for interconnecting flat cable insulated conductors associated with a multi-phase electrical power supply to a three conductor single phase element in alternative single phase configurations, including a single phase connector having three separate insulation penetrating, conductor engagable connector contact elements located in an insulated housing and having the same pitch as the flat cable conductors; the apparatus being characterized by an adapter assembly, disposable between the single phase connector and the flat cable conductors, and including three adapter contact elements, each having an upper contact part comprising means for engaging insulation penetrating conductor engagable connector contact elements, and at least one selectively laterally disposable lower insulation penetrating contact part engagable with a selected one of the flat cable conductors; corresponding upper and lower contact parts being joined in the adapter assembly to form the alternative single phase configurations.

15. The appparatus of claim 14 wherein the adapter assembly further comprises an insulating body, the adapter contact element upper and lower contact parts being on oppositely facing surfaces of the body.

16. The apparatus of claim 15 further comprising a plurality of laterally extending channels on at least one surface of the adapter insulating body and members disposable in the channels to join corresponding relatively laterally disposed upper and lower contact parts.

17. An assembly for distribution of single phase electrical power from a multi-phase electrical system, comprising:

a flat cable having a plurality of flat conductors disposed side-by-side and surrounded by electrical insulation, the flat cable including at least primary, secondary, ground and neutral conductors;

a single phase connector having three separate connector contact elements, each having conductor engagable portions comprising means for penetrating flat cable insulation into a flat conductor therein;

an adapter assembly disposed between the single phase connector and the flat cable conductors and including three adapter contact elements, each having an upper contact part in engagement with a corresponding conductor engagable connector contact element and a lower contact part, the lower contact parts of the adapter contact elements being selectively laterally disposable and having a conductor engagable portion penetrating flat cable insulation into a corresponding flat conductor; and conductive portions in the adapter assembly, joining corresponding upper and lower contact parts to form alternative single phase configurations.

18. Apparatus for interconnecting flat cable conductors having insulation therearound, and associated with a three phase power supply, including primary, secondary, tertiary, ground and neutral conductors, to a three conductor single phase outlet in alternative single phase configurations, including an outlet connector assembly further comprising a base portion and an insulating terminal block structure; the terminal block structure including a first side, a second side, and terminal receiving cavities extending between said sides; electrical terminals situated in respective cavities in the terminal block; each terminal being stamped and formed with a receptacle portion and a planar plate conductor insulation penetrating terminating portion, the receptacle portion opening toward the first side of the block, the terminating portion emerging from the cavity and lying against the second side of the terminal block, the planar plate terminating portion having raised relief lances thereon which face outwardly from second side, said lances adapted to penetrate completely through a layer of insulation of the cable and into the flat conductors when said cable is clamped between said second side of said terminal block and the base portion such that the planar plate terminating portions face respective flat conductors in said cable; and characterized by an adapter assembly disposable between the outlet connector assembly and the five conductor flat cable and comprising an insulating body and connector elements mounted thereon, the connector elements comprising upper contact parts comprising means for interconnecting to the terminal planar plate insulation penetrating portions and lower contact parts comprising insulating-penetrating means disposable in contact with any three of the five flat cable conductors, and means for connecting corresponding upper contact parts and lower contact parts, whereby the single phase outlet can be alternatively interconnected in a selected one of a ground primary single phase connection, a ground secondary single phase connection, a ground tertiary single phase connection, an isolated ground primary single phase connection, and an isolated ground secondary single phase connection.

* * * * *